US007490784B2

(12) United States Patent
Fath

(10) Patent No.: US 7,490,784 B2
(45) Date of Patent: Feb. 17, 2009

(54) INJECTOR FOR INJECTING FUEL

(75) Inventor: Andreas Fath, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 436 days.

(21) Appl. No.: 11/008,415

(22) Filed: Dec. 9, 2004

(65) Prior Publication Data

US 2005/0116066 A1 Jun. 2, 2005

Related U.S. Application Data

(63) Continuation of application No. PCT/DE03/01879, filed on Jun. 3, 2003.

(30) Foreign Application Priority Data

Jun. 10, 2002 (DE) ..... 102 25 683

(51) Int. Cl.
*B05B 1/26* (2006.01)

(52) U.S. Cl. ..... 239/601; 239/584; 239/596

(58) Field of Classification Search ..... 239/104, 239/106, 494, 497, 533.12, 584, 596, 601
See application file for complete search history.

(56) References Cited

U.S. PATENT DOCUMENTS

| | | | | |
|---|---|---|---|---|
| 5,626,295 | A * | 5/1997 | Heyse et al. | 239/596 |
| 5,752,316 | A * | 5/1998 | Takagi et al. | 29/888.4 |
| 5,909,846 | A * | 6/1999 | Sasaki | 239/106 |
| 6,991,188 | B2 * | 1/2006 | Kobayashi et al. | 239/596 |

FOREIGN PATENT DOCUMENTS

| | | |
|---|---|---|
| DE | 2921455 | 11/1980 |
| DE | 19854828 | 5/2000 |
| DE | 10116714 | 10/2002 |

OTHER PUBLICATIONS

PCT International Search Report Application No. PCT/EP03/01879, 2 pages, Mailed Oct. 29, 2003.

* cited by examiner

*Primary Examiner*—Steven J Ganey
(74) *Attorney, Agent, or Firm*—Baker Botts L.L.P.

(57) ABSTRACT

The invention relates to an injector for injecting fuel into a combustion chamber. The injector comprises at least one spray orifice with an inlet opening and an outlet opening. The spray orifice has a device for specifically producing cavitation at the outlet opening in order to remove deposits from the outlet opening that are produced during operation.

17 Claims, 2 Drawing Sheets

INJECTOR FOR INJECTING FUEL

CROSS-REFERENCE TO RELATED APPLICATION OR PRIORITY

This application is a continuation of co-pending International Application No. PCT/DE03/01879 filed Jun. 3, 2003 which designates the United States, and claims priority to German application number DE10225683.7 filed Jun. 10, 2002.

FIELD OF THE INVENTION

The present invention relates to an injector for injecting fuel into a combustion chamber of an internal combustion engine through at least one spray orifice.

BACKGROUND OF THE INVENTION

With known injectors for injecting fuel into a combustion chamber, injection orifices through which the fuel is injected into the combustion chamber are typically configured in a cylindrical manner. One or two spray orifices were thereby hitherto provided. To improve the exhaust gas behavior of the internal combustion engine, it was proposed that the spray orifices should be manufactured with smaller diameters and that the number of spray orifices should be increased at the same time. Extensive motor tests have however shown that when contaminated fuel is used, which by way of example contains an increased concentration of inert substances such as zinc, copper etc, as well as their compounds, deposits (carbonization) form at the outlet opening of the spray orifices. The flow through the spray orifice is thereby reduced so that the quantity injected into the motor decreases and the power of the motor thus drops continuously. This problem in particular results in the case of large and maximum load conditions, with high temperatures.

Patent specification DE 98 54 828 A1 discloses an injector for injecting fuel into an internal combustion engine, which comprises at least one injection orifice with an inlet opening and an outlet opening. The spray orifice cross-section extends outwards in the direction of the side opposite the valve seat surface, in other words towards the combustion chamber of the internal combustion machine, whereby it is already possible to generate a cavitation or turbulence so that the fuel jet decays significantly closer to the nozzle.

SUMMARY OF THE INVENTION

The object of the invention is therefore to provide an injector with a spray orifice for injecting fuel, which has a simple structure and is simple and economical to produce whilst still preventing carbonization of the spray orifices.

This object is achieved by means of an injector with the following features: at least one spray orifice having an inlet opening and an outlet opening, the spray orifice having a means for producing cavitation at the outlet opening in order to remove deposits at the outlet opening occurring during operation, said means being integrated in the injection orifice and comprising a geometric shape configuration of the injection orifice, wherein the spray orifice comprises a barrel-like cross-sectional shape, initially widening in the flow direction and subsequently tapering.

The spray orifice preferably has a symmetrical barrel shape so that it is simple to produce. It is also preferable for the cross-sectional area of the inlet of the barrel-shaped injection orifice to be greater than or equal to the cross-sectional area of the outlet. It is also preferable for the cross-sectional area of the inlet and the cross-sectional area of the outlet respectively to be circular, whereby the inlet diameter is greater than or equal to the outlet diameter. Preferably the ratio of the inlet diameter to the maximum diameter of the barrel-shaped spray orifice is thereby between 0.9 and 0.95. The reliable prevention of deposits is thereby possible when the ratio of the inlet diameter is between 5 μm and 25 μm smaller than the maximum diameter of the barrel-shaped spray orifice. Deposits can be reliably prevented with a difference of at least 10 μm between the inlet diameter and the maximum diameter. Furthermore, it is preferable for the ratio of the inlet diameter to the outlet diameter of the barrel-shaped spray orifice to be between 1 and 1.3, in particular 1.1.

According to another preferred geometric configuration of the spray orifice, the ratio of the spray orifice length to the mean diameter of the spray orifice is less than or equal to 6.5. The mean diameter here is the average diameter over the length of the spray orifice. By designing the spray orifice according to the aforementioned formula, the specific occurrence of cavitation can be achieved on a predefined scale. The shape of the spray orifice is thereby arbitrary and can for instance be cylindrical, tapering, in particular conical, or barrel-shaped.

According to a further preferred embodiment of the present invention, the carbonization tendency of the spray orifice can be reduced, in that a sharp edge is configured at the outlet opening. In other words, the edges out at the outlet opening are not rounded, so that there is a sharp transition between the spray orifice and the combustion chamber. This sharp transition prevents deposits of inert substances, thereby ensuring at the same time that cavitation bubbles occur at the edge of the spray orifice and can implode there.

It should be noted that when fuel with no zinc or copper contamination, etc. is used, despite the devices for specifically producing cavitation at the outlet opening, no cavitation wear occurs at the outlet opening itself, since according to the invention, cavitation can be adjusted so precisely deposits are only removed when they form. Furthermore, deposits consisting of carbonization are easier to remove than the material from which the spray orifice is formed, since this material is more resistant to cavitation.

The present invention can be used both with injectors having seat nozzles (VCO) and injectors having blind hole nozzles.

The present invention is described in more detail below with reference to preferred exemplary embodiments, in conjunction with the drawings.

DETAILED DESCRIPTION OF EMBODIMENTS

Figure 1:
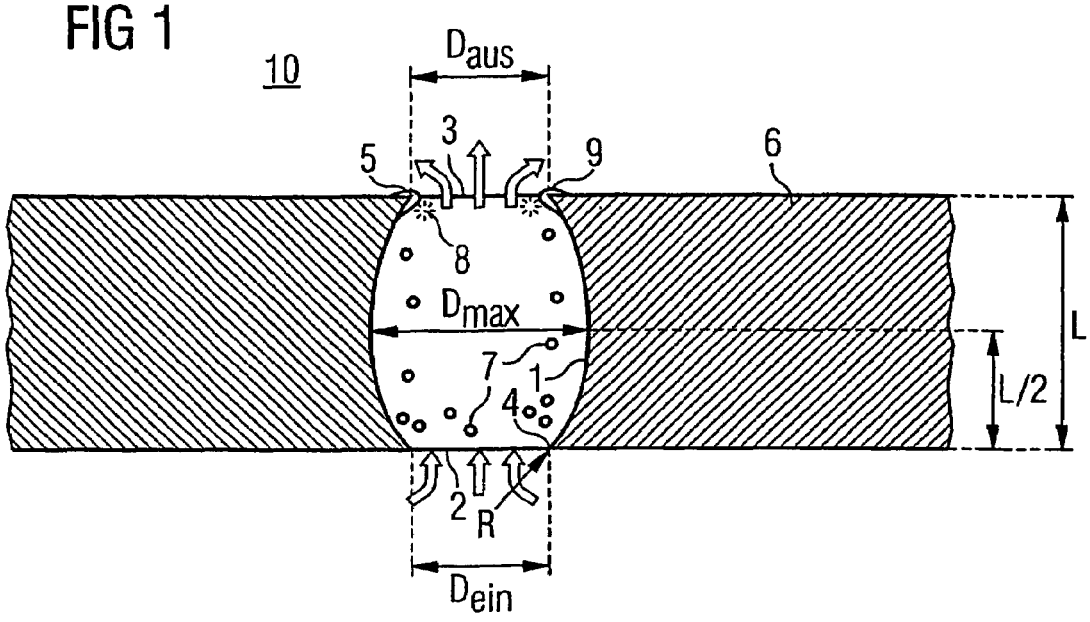
FIG. 1 shows a schematic sectional view of a spray orifice according to a first exemplary embodiment of the present invention.
Figure 2:
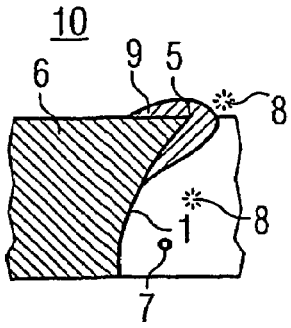
FIG. 2 shows an enlarged view of the outlet edge of the spray orifice in FIG. 1.

A spray orifice 1 according to a first exemplary embodiment of the present invention is described below with reference to FIGS. 1 and 2. The spray orifice 1 has a symmetrical barrel shape as illustrated in FIG. 1. The spray orifice 1 is thereby both symmetrical in respect of a plane containing the center axis of the spray orifice and symmetrical in respect of an imaginary plane through the maximum diameter $D_{max}$ of the spray orifice. The spray orifice 1 features an inlet opening 2 and an outlet opening 3. The diameter $D_{Ein}$ of the inlet opening 2 is thereby equal to the diameter $D_{Aus}$ of the outlet opening 3, whereby the openings 2, 3 are circular.

The spray orifice 1 is formed in a known manner in a nozzle body 6, and arranged at the injection end of a blind hole. The blind hole comprises a valve seat surface, which is released or closed by means of a valve needle, in order to implement an injection operation. The fuel enters the spray orifice 1 at the inlet opening 2 and flows out of the outlet opening 3 into a combustion chamber 10 of an internal combustion engine. As illustrated in FIG. 1, the maximum diameter $D_{max}$ of the spray orifice 1 is arranged halfway along the length L/2 of the total length L of the spray orifice.

According to the first exemplary embodiment, the ratio of the inlet diameter $D_{Ein}$ to the maximum diameter $D_{max}$ is 0.91. Since the inlet diameter $D_{Ein}$ is equal to the outlet diameter $D_{Aus}$, the ratio of the inlet diameter ratio to the outlet diameter is 1.

The flow direction and the deflections at the spray orifice 1 of the flow are illustrated in the Figure by means of arrows. The geometric shape of the barrel-shaped spray orifice produces a major deflection of the flow at the inlet opening 2, resulting in cavitation bubbles 7. To achieve the best possible flow at the inlet opening 2, the inlet edge 4 of the inlet opening 2 is rounded with a predefined radius R. The cavitation tendency is specifically increased by influencing of pressure and flow speed correspondingly, as a function of the diameter $D_{Ein}$ and the rounding R of the inlet edge. The resulting cavitation bubbles 7 are carried along by the flow. The cavitation bubbles implode due to the large pressure differences in the spray orifice 1, as designated in the Figures with the reference character 8. As a result of the imploding cavitation bubbles 8, pressure waves of several 1000 bar occur, as a result of which the outlet opening 3 is freed of the deposits 9 occurring there. Automatic cleaning of the spray orifice 1 is therefore possible. It should be noted that the tendency of the cavitation bubbles 7 to implode at the outlet opening 3 can also be specifically adjusted by configuring a sharp outlet edge 5. In the present exemplary embodiment, the outlet edge 5 is configured as a sharp edge.

Figure 3:
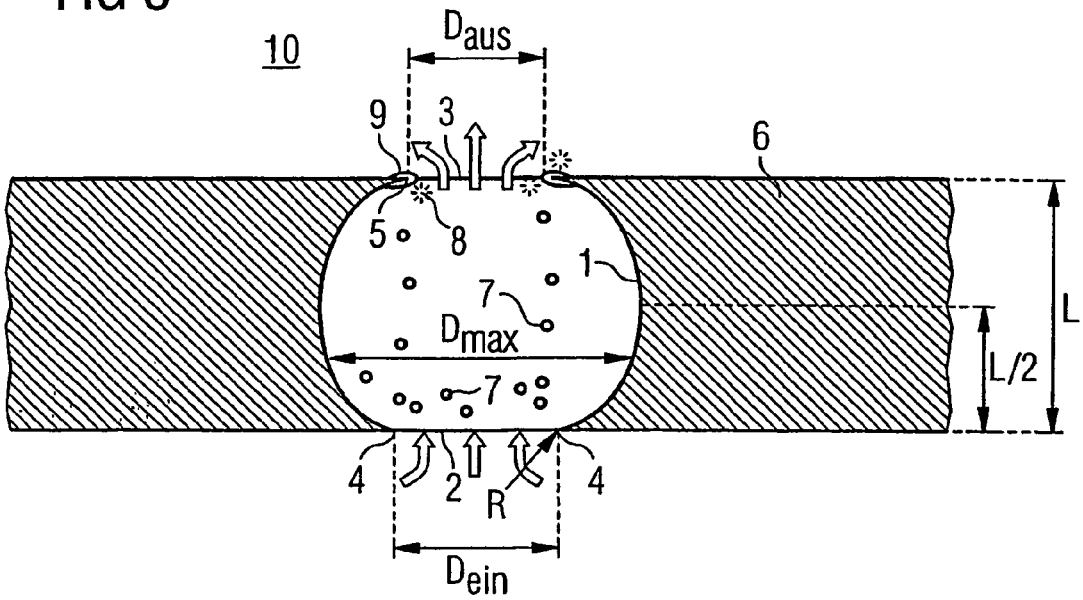
FIG. 3 shows a schematic sectional view of a spray orifice according to a second exemplary embodiment of the present invention.

A spray orifice 1, according to a second exemplary embodiment of the present invention, is described below with reference to FIG. 3. The same components are hereby designated with the same reference characters as in the first exemplary embodiment.

The spray orifice 1, according to the second exemplary embodiment, essentially corresponds to the first exemplary embodiment, with the difference however being that it is only configured as symmetrical in respect of the plane through the center axis of the spray orifice, and as asymmetrical in respect of a plane halfway along the length L/2 of the wall thickness L of the nozzle body 6. In other words, the maximum diameter $D_{max}$ of the barrel-shaped spray orifice 1 is arranged according to the second exemplary embodiment between the inlet opening 2 and halfway along the length L/2 of the spray orifice 1 (See FIG. 3). The ratio of the inlet diameter $D_{Ein}$ to the maximum diameter $D_{max}$ is thus 0.94. Furthermore, the ratio of the inlet diameter $D_{Ein}$ to the outlet diameter $D_{Aus}$ is 1.05. In other respects, this exemplary embodiment corresponds to the first exemplary embodiment so that reference can be made to the description above.

Figure 4:
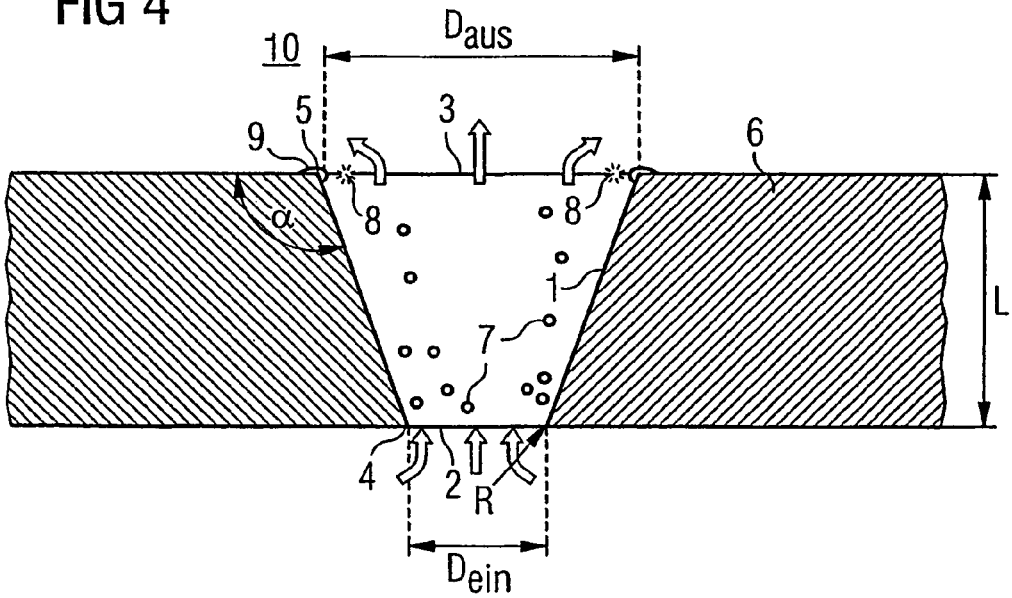
FIG. 4 shows a schematic sectional view of a spray orifice according to a third exemplary embodiment of the present invention.

A third exemplary embodiment according to the present invention is described below with reference to FIG. 4, wherein the same components are referred to using the same reference characters as in the preceding exemplary embodiment. As shown in FIG. 4, an outlet edge 5 with an angle $\alpha$ is configured between the outer face of the nozzle body 6 and the spray orifice 1 at the outlet opening 3, so that a sharp transition results from the spray orifice to the combustion chamber 10.

As shown in FIG. 4, according to a fourth exemplary embodiment, the spray orifice 1 is configured to expand in the flow direction and more precisely to expand conically. As with the preceding exemplary embodiments, cavitation bubbles 7 are thereby produced at the inlet opening, which cavitate as a result of the pressure increase on leaving the spray orifice 1, so that any deposits 9 present can be removed by means of the imploding cavitation bubbles 8.

I claim:

1. An injector for injecting fuel into a combustion chamber, said injector comprising:

at least one spray orifice having an inlet opening and an outlet opening, the spray orifice being designed to produce cavitation at the outlet opening in order to remove deposits at the outlet opening occurring during operation, said spray orifice being formed in a nozzle body and comprising a barrel-like cross-sectional shape, initially widening in the flow direction and subsequently tapering, wherein the ratio of the inlet opening diameter to the maximum diameter of the spray orifice is between 0.9 and 0.95.

2. An injector according to claim 1, wherein the cross-sectional area of the inlet of the barrel-shaped spray orifice is greater than or equal to the cross-sectional area of the outlet.

3. An injector according to claim 2, wherein a sharp edge is configured at the outlet opening, and a predefined rounding is configured at an edge of the inlet opening.

4. An injector according to claim 1, wherein the spray orifice has a symmetrical barrel-shape.

5. An injector according to claim 4, wherein the cross-sectional area of the inlet and the cross-sectional area of the outlet are circular and the inlet opening diameter is identical to the outlet opening diameter.

6. An injector according to claim 1, wherein the ratio of the inlet opening diameter to the maximum diameter of the spray orifice is 0.91.

7. An injector according to one of claim 1, wherein the inlet opening diameter is between 5 μm and 25 μm smaller than the maximum diameter of the spray orifice.

8. An injector according to claim 1, wherein the inlet opening diameter is 10 μm smaller than the maximum diameter of the spray orifice.

9. An injector according to one of claim 1, wherein the ratio of the inlet opening diameter to the outlet opening diameter lies between 1 and 1.1.

10. An injector according to claim 1, wherein the ratio of the inlet opening diameter to the outlet opening diameter is 1.05.

11. An injector according to claim 1, wherein the ratio of the spray orifice length to its mean diameter is less than or equal to 6.5, wherein the mean diameter is the average diameter over the length of the spray orifice.

12. An injector according to claim 1, wherein a sharp edge is configured at the outlet opening, and a predefined rounding is configured at the edge of the inlet opening.

13. An injector for injecting fuel into a combustion chamber, said injector comprising:

at least one spray orifice having an inlet opening and an outlet opening, the spray orifice having a means for producing cavitation at the outlet opening in order to remove deposits at the outlet opening occurring during operation, said means being integrated in the spray orifice and comprising a geometric shape configuration of the spray orifice, wherein the spray orifice comprises a shape which conically expands in the flow direction, wherein the ratio of the spray orifice length to its mean diameter is less than or equal to 6.5, wherein the mean diameter is the average diameter over the length of the spray orifice.

14. An injector according to claim 13, wherein the spray orifice is cylindrical.

15. An injector according to claim 13, wherein the spray orifice is frustum shaped wherein the minimum diameter of the orifice is located at the inlet opening and the maximum diameter of the orifice is located at the outlet opening.

16. An injector for injecting fuel into a combustion chamber, said injector comprising:

at least one spray orifice having an inlet opening and an outlet opening, the spray orifice being designed to produce cavitation at the outlet opening in order to remove deposits at the outlet opening occurring during operation, said spray orifice being formed in a nozzle body and comprising a barrel-like cross-sectional shape, initially widening in the flow direction and subsequently tapering, wherein the inlet opening diameter is between 5 μm and 25 μm smaller than the maximum diameter of the spray orifice.

17. An injector for injecting fuel into a combustion chamber, said injector comprising:

at least one spray orifice having an inlet opening and an outlet opening, the spray orifice having a means for producing cavitation at the outlet opening in order to remove deposits at the outlet opening occurring during operation, said means being integrated in the spray orifice and comprising a geometric shape configuration of the spray orifice, wherein the spray orifice comprises a barrel-like cross-sectional shape, initially widening in the flow direction and subsequently tapering, wherein the ratio of the spray orifice length to its mean diameter is less than or equal to 6.5, wherein the mean diameter is the average diameter over the length of the spray orifice.

* * * * *